United States Patent [19]

Inglis

[11] 4,305,339

[45] Dec. 15, 1981

[54] VORTEX TUBE ASSEMBLY FOR COOLING SEWING MACHINE NEEDLE

[75] Inventor: Leslie R. Inglis, Cincinnati, Ohio

[73] Assignee: Vortec Corporation, Cincinnati, Ohio

[21] Appl. No.: 80,010

[22] Filed: Sep. 28, 1979

[51] Int. Cl.[3] ..... D05B 71/00
[52] U.S. Cl. ..... 112/281
[58] Field of Search ..... 112/281, 280, 270; 62/5

[56] References Cited

U.S. PATENT DOCUMENTS

| | | | |
|---|---|---|---|
| 2,669,207 | 2/1954 | Happe | 112/281 |
| 3,483,836 | 12/1969 | Meersand | 112/281 |
| 3,910,210 | 10/1975 | Marforio | 112/281 |
| 4,193,364 | 3/1980 | Dunne | 112/281 |

FOREIGN PATENT DOCUMENTS

| | | | |
|---|---|---|---|
| 183580 | 11/1966 | U.S.S.R. | 112/281 |

*Primary Examiner*—Ronald Feldbaum
*Attorney, Agent, or Firm*—Tilton, Fallon, Lungmus

[57] ABSTRACT

An apparatus for cooling the needle of a sewing machine to reduce problems of thread breakage because of frictional heat build-up. The apparatus includes a vortex tube secured to the worktable for a sewing machine at a point remote from the sewing head of that machine, a nozzle assembly affixed to the pressure foot bushing of the machine and directed towards the sewing needle, and an elongated insulated noise-muffling hose extending from the cold air outlet of the remotely-positioned vortex tube to the nozzle assembly. The nozzle assembly includes a generally vertically oriented nozzle tube having a plurality of side openings for directing jets of cooling air towards the sewing needle, and an adjustable sleeve for controlling the discharge of such air.

13 Claims, 5 Drawing Figures

VORTEX TUBE ASSEMBLY FOR COOLING SEWING MACHINE NEEDLE

BACKGROUND AND SUMMARY

Counterflow vortex tubes and their method of operation are well known, such tubes being described, for example, in Fulton U.S. Pat. Nos. 3,173,273 and 3,208,229, and Ranque U.S. Pat. No. 1,952,281. Compressed air (or other gas) from any suitable source enters such a tube and is throttled through nozzles to produce the special temperature change effects which are the unique characteristics of a vortex tube. The result is that the compressed air entering the body of the tube is divided into hot and cold fractions discharged from outlets at opposite ends of the tube. Usually a vortex tube is used for the cold air produced with typical temperatures at the cold air outlet ranging from minus 40° F. to plus 30° F.

The cold air from vortex tubes has been used as a coolant in a wide variety of drilling, milling, sawing, and grinding applications. In such an installation, the vortex tube is ordinarily mounted in close proximity to the operating element (i.e., drill, saw, grinding wheel, etc.) with the cold air outlet of the tube pointed towards the workpiece. The cold air discharged from the tube prevents overheating of the workpiece as well as the operating element and, in addition, directs debris away from the work zone.

It has been recognized that heat build-up may also be a problem in commercial sewing machine operations where speeds of 5,000 stitches per minute or more are not uncommon. Frictional heat is generated as the sewing needle passes through the fabric and when the thread travels through the eye of the needle. Thread breakage, resulting in machine downtime and loss of productivity, may be occasioned because of burning or melting (in the case of synthetic materials) of the thread. In some cases the heating and softening of a synthetic thread may cause a clogging of the eye of the needle, thereby increasing frictional resistance and ultimate thread breakage. While undesirable heat build-up leading to thread breakage may occur when a sewing machine runs without interruption for extended periods the problem is also likely to occur when such a machine is operated intermittently with relatively short bursts at high operating speeds.

Efforts have been made to utilize vortex tube cooling devices to prevent thread breakage in the operation of industrial sewing machines but such efforts have met with only limited success. The mounting of a vortex tube adjacent the head of a sewing machine poses problems which vary according to the differences in configuration and design of different brands of machines but, even under the most favorable conditions, only limited mounting space is available and, when such space is occupied by a vortex tube, the added equipment may make operation of the sewing machine less convenient for the user. To provide a secure attachment of such a vortex tube at or near the head of the machine, it has been considered necessary to drill mounting holes into the machine, an operation which users may not be readily equipped to perform and which may in some cases damage or adversely affect operation of the machine.

One aspect of this invention therefore lies in recognizing that the problems associated with the use of a vortex tube to cool the needle of a sewing machine may be eliminated or greatly reduced by mounting the tube upon the worktable at a point remote from the sewing head and then directing cooling air from the remotely-located vortex tube through an insulated sound-muffling hose to a small nozzle mounted immediately adjacent the sewing needle. Because of its small size, the nozzle does not obstruct the user's view of the work area. In the best mode presently known for practicing the invention, the nozzle is mounted directly upon the pressure foot bushing and is provided with a plurality of vertically-spaced openings for directing a curtain of cooling air against the sewing needle.

The remote location of the vortex tube provides a number of important advantages in addition to keeping a relatively bulky component away from the work area. The hot air necessarily discharged from the vortex tube may be easily directed away from the user and in any event is not discharged into the immediate work area. The noise generated by the operation of the vortex tube is less objectionable, first, because, the tube is spaced a substantial distance away from the user, and second, because the elongated hose leading from the remote vortex tube to the discharge nozzle also functions as a noise-abating muffler. The insulation responsible for damping the noise generated by the vortex tube also functions as thermal insulation. Therefore, despite the fact that cold air is conducted a substantial distance through the hose from the remote vortex tube to the nozzle, the heat and humidity sometimes encountered in factories where garments are made is less likely to cause condensation that might otherwise drip from the hose and mar or damage the article being sewn.

Because of its small size and its attachment directly to the pressure foot bushing, the vertically-elongated nozzle with its lateral discharge ports does not obstruct or interfere with operation of the machine or with the movement of fabric beneath the sewing head. A control member in the form of a sleeve is slidably mounted upon the nozzle tube for deflecting or blocking the flow of air from some or all of the orifices when such flow might interfere with threading of the needle or with some other preliminary operations involving the needle and its associated elements.

Other features, advantages, and objects of the invention will become apparent from the specification and drawings.

DRAWINGS

FIG. 3 is a fragmentary elevational view showing the nozzle assembly as in FIG. 2 but with the deflecting sleeve in a second position of adjustment.

FIG. 4 is a perspective view of the nozzle assembly.

FIG. 5 is an enlarged horizontal sectional view taken along line 5—5 of FIG. 2.

DETAILED DESCRIPTION

Figure 1:
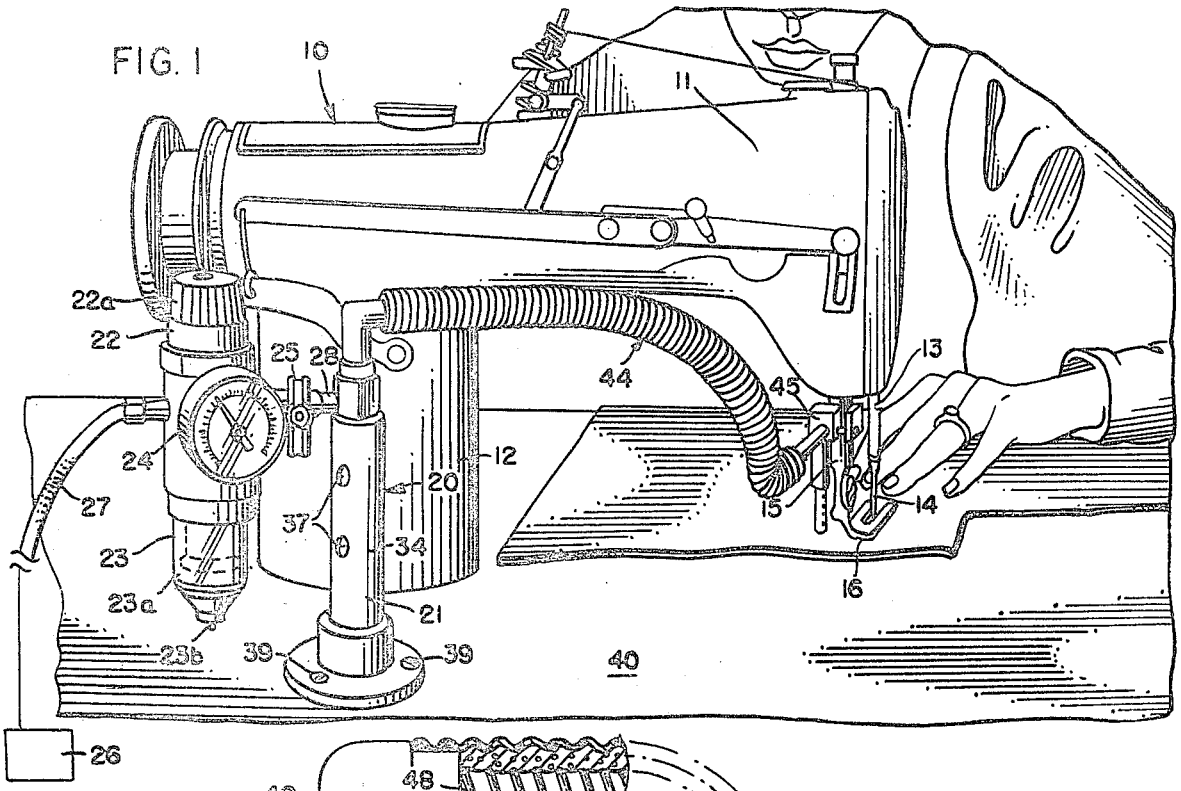
FIG. 1 is a perspective view of the apparatus mounted for use with a conventional industrial sewing machine.

Referring to the drawings, the numeral 10 generally designates a conventional industrial sewing machine having a cantilevered sewing head 11 and an upstanding base or support column 12. A needle arm assembly 13 extends downwardly from the head and includes a reciprocating sewing needle 14 (FIG. 4). Immediately adjacent the needle arm assembly is the pressure foot assembly 15. As is well known, the pressure foot 16 is movably carried by a pressure foot bushing 17 and may be raised and lowered by the operator. When lowered, the pressure foot is used to guide the fabric being sewn and to maintain such fabric in contact with the advancement mechanism on the underside of the fabric. Since such components and their operation are entirely conventional and are well known in the art, a more detailed description is believed unnecessary herein. For further information concerning the construction and operation of conventional sewing machines, reference may be had to any of the operating and service manuals for such machines and to any of a wide variety of instruction booklets on sewing and sewing machines.

Numeral 20 generally designates a needle cooling apparatus comprising a vortex tube assembly 21, a pressure regulator 22, a filter 23, pressure gauge 24, and shut off valve 25. The pressure regulator, filter, gauge, and shut off valve are all standard commercially-available elements, some or all of which may be omitted depending in part on the condition and quality of the air supplied to the assembly from source 26 and supply line 27. Thus, if the air supplied from source 26 is at a substantially constant pressure within the range of approximately 80 to 110 psig, is at room temperature or, in any event, at a temperature no greater than approximately 150° F., and is both filtered and dehumidified, then pressure regulator 22, gauge 24, and filter 23 may be omitted. Shut off valve 25 may also be omitted if there are other suitable shut off means elsewhere in the system.

Pressure regulator 22 functions to deliver air at a selected constant pressure to the inlet 28 of the vortex tube assembly 21, regardless of fluctuations in air pressure in line 27, as long as the pressure setting (controlled by knob 22*a* and represented on gauge 24) is lower than the supply line pressure. Filter 23 operates to remove particulates and water from the supplied air, the water being collected in a bowl 23*a* which may be periodically drained by means of drain valve 23*b*. Valve 25, whe provided, may be utilized to turn off the supply of air to the vortex tube assembly when the sewing machine is not in use, thereby conserving compressed air and minimizing noise.

Figure 2:
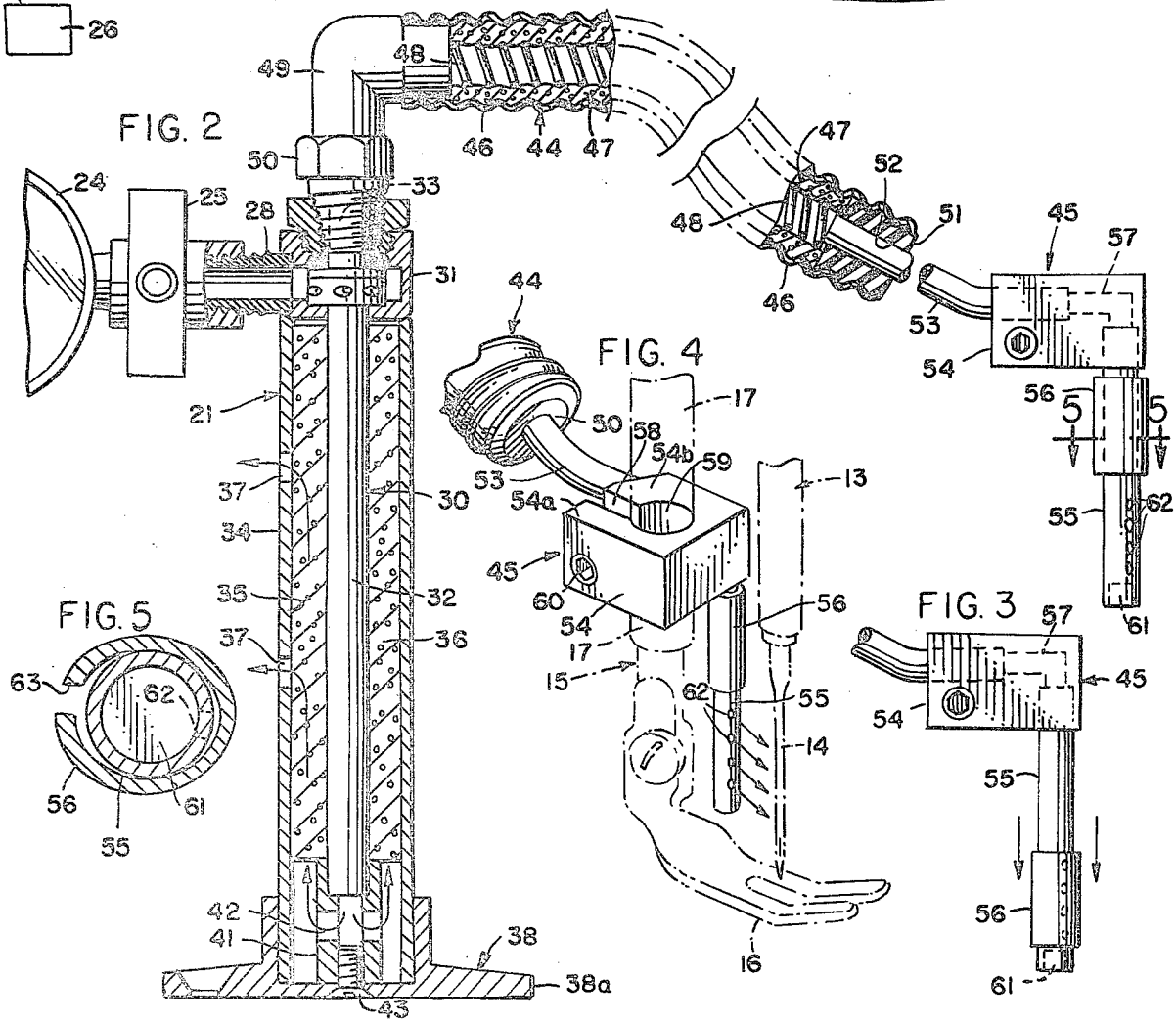
FIG. 2 is a fragmentary elevational view, partly in section, of the vortex tube, hose, and nozzle assemblies.

Referring to FIG. 2, the vortex tube assembly 21 includes a conventional vortex tube 30 similar in construction to the vortex tubes disclosed in the aforementioned patents. Vortex tube 30 has a generator body 31, an elongated hot air outlet tube 32, and a shorter cold air outlet tube 33. The vortex tube is vertically oriented with its hot air outlet tube facing downwardly and its cold air outlet tube projecting upwardly. A cylindrical housing 34 extends about the hot air outlet tube and defines an annular chamber 35 containing a sleeve 36 of open-celled polymeric foam or any other porous and durable filtering material. The wall of the tubular housing 34 is provided with at least one hot air discharge port 37. Ideally, a plurality of such ports are provided and are located along one side of the housing so that hot air discharged from the assembly may be directed away from the sewing machine operator (FIG. 1).

The lower end of housing 34 is received within the mouth of a base 38, the base having an apertured flange 38*a* which may be secured by screws 39, or by any other suitable means, to the worktable 40. A tubular extension 41 is secured to the lower end of hot air outlet tube 32 and is provided with lateral openings 42 for redirecting the hot air upwardly through the porous medium 36 towards discharge openings 37. As shown in FIG. 2, the tubular extension 41 is internally threaded at its lower end to receive screw 43 which secures the base, housing, and vortex tube together.

In addition to the vortex tube assembly 21 and its associated elements, the apparatus includes an elongated insulated hose assembly 44 connected at one end to the cold air outlet of the vortex tube and at its other end to a nozzle assembly 45. The hose or conduit 44 is flexible and includes an impervious outer tubular wall 46 and an inner tubular core 47, the latter being formed of polyurethane foam or other porous material of low heat conductivity. Other polymeric foam materials may be used, as well as fibrous synthetic and natural materials. The passage through the core 47 may be maintained in open condition, without preventing contact between the cold air and the porous core and without impairing flexibility of the hose, by helical spring 48. An end fitting 49, equipped with threaded connector 50, secures the hose assembly to the cold air outlet of the vortex tube assembly 21.

At its opposite end, the flexible hose 44 is provided with a resilient plug 51 which has a bore 52 receiving the tubular stem 53 of nozzle assembly 45. In the embodiment shown, the nozzle assembly includes, in addition to stem 53, a mounting block 54, a depending nozzle tube 55, and a slidable collar or sleeve 56 carried upon the nozzle tube.

The mounting block, shown most clearly in FIGS. 2–4, contains a passage 57 which is counterbored to receive the ends of tubular stem 53 and nozzle tube 55. The block is also provided with a vertical cleft 58 leading to a cylindrical vertically-extending opening 59 dimensioned to receive the pressure foot bushing 17 of any of a variety of industrial sewing machines. In general, the diameter of opening 59 should fall within the range of about 0.420 to 0.560 inches. The cleft or slot 58 effectively divides a portion of the block to define a pair of clamping jaws 54*a* and 54*b*, such jaws being bridged by a screw 60 which may be rotated to urge the jaws towards or away from each other to tighten or loosen the mounting block with respect to a pressure foot bushing 17.

The depending nozzle tube 55 is closed at its lower end by plug 61 and has a plurality of jet openings or orifices 62 arranged in a vertical series extending along the tube's lower end portion. As shown in FIG. 4, the nozzle assembly 45 is designed to be mounted upon the pressure foot bushing 17 of a sewing machine so that the series of orifices 62 extend along the same plane as needle 14 with each orifice directed towards the axis of the sewing needle. Therefore, with collar 56 in its raised position and with vortex tube assembly 21 in operation, a vertical wall or curtain of cooling air is directed towards the sewing needle.

FIG. 5 depicts in exaggerated form the structural relationship which permits selective adjustment of the collar 56 between its raised and lowered positions, and causes frictional retention of the collar in whatever axial position of adjustment is selected. It will be observed that collar 56, when viewed in horizontal section, is slightly out-of-round. The slight ovalized collar is formed of flexible material (metal or plastic) and, in an untensioned state, has an inside diameter measured across its shorter transverse axis that is slightly less than the outside diameter of the generally cylindrical nozzle tube. Therefore, when the parts are assembled as shown, the spring action of the collar produces a frictional gripping force which is sufficient to hold the collar in any selected position of adjustment along the nozzle tube without, at the same time, requiring the user to exert undue force when a change in the vertical position of the collar is desired.

FIG. 5 also reveals that the collar may be C-shaped in horizontal section; that is, the collar may have a vertical slit extending its full length. Such slit may be omitted if desired. It is useful in facilitating fabrication of the assembly and also for allowing deflected air to escape from the nozzle tube (but in a direction other than the direction in which nozzle orifices 62 are facing) when the collar is in its lowered position. It is also believed apparent from FIG. 5 that the deflected air may escape through the arcuate spaces extending the full length of the collar's inside surface.

An important aspect of the invention lies in the fact that vortex tube assembly 21 is secured to table top 40 at a point a substantial distance from sewing needle 14 and from the work area surrounding that needle. As a result, hot air is discharged from the vortex tube at a point remote from the operator. Noise generated by the vortex tube is also reduced as far as the operator is concerned because of the remote location of the tube. No mounting holes are required to be drilled into the casing of the sewing machine, nor are any brackets or other attachment means required for securing the vortex tube directly to the machine. The remote positioning of the vortex tube leaves the work area clear so that none of the components of the apparatus interfere with advancement of the fabric as it is sewn by the machine. The elongated insulated hose not only functions to convey cold air to the nozzle assembly from the remotely-located vortex tube but also effectively muffles the sound of air discharged from the cold air outlet of the tube.

While in the foregoing I have disclosed an embodiment of the invention in considerable detail for purposes of illustration, it will be understood by those skilled in the art that many of these details may be varied without departing from the spirit and scope of the invention.

I claim:

1. An apparatus for cooling the needle of a sewing machine mounted upon a worktable and equipped with a pressure foot bushing adjacent such needle, comprising a vortex tube having an air inlet for receiving pressurized air, a hot air outlet, and a cold air outlet; a base secured to said vortex tube and equipped with mounting means for attaching the same to a worktable at a point remote from the needle of a sewing machine; a nozzle assembly with means for securing said assembly to the pressure foot bushing of a sewing machine for directing air towards the needle thereof; and an elongated sound-muffling temperature-insulating hose extending from the cold air outlet of said vortex tube to said nozzle assembly.

2. The apparatus of claim 1 in which said vortex tube includes an elongated housing providing a tubular wall extending about said vortex tube; said housing being vertically oriented and being secured at its lower end to said base.

3. The apparatus of claim 2 in which said housing has at least one hot air discharge port in the tubular wall thereof.

4. The apparatus of claim 3 in which said vortex tube includes a generator body, an elongated downwardly-extending hot air outlet tube, and an upstanding cold air outlet tube; said housing wall extending about said hot air outlet tube and being spaced therefrom to define an annular chamber therebetween; and a porous sound-insulating material within said chamber interposed between said hot air outlet of said vortex tube and said discharge port of said housing.

5. The apparatus of claim 1 in which said securing means of said nozzle assembly includes a mounting block having a pair of clamping arms adapted to receive therebetween and securely engage the pressure foot bushing of a sewing machine.

6. The apparatus of claim 1 in which said nozzle assembly includes a depending nozzle tube in flow communication with said hose; said nozzle tube being closed at its lower end and having at least one laterally-facing orifice for directing cool air towards a sewing machine needle.

7. The apparatus of claim 6 in which said nozzle tube is provided with a plurality of said orifices spaced apart in a vertically-extending series.

8. The apparatus of claim 7 in which a sleeve is slidably mounted upon said nozzle tube; said sleeve having a length less than that of said nozzle tube and being shiftable between raised and lowered positions therealong.

9. The apparatus of claim 8 in which said sleeve is formed of flexible material and is slightly out-of-round; said sleeve when in an untensioned state having an inside diameter measured along its smaller transverse axis that is slightly less than the outside diameter of the nozzle tube, whereby, said sleeve frictionally grips said tube to retain the same in selected positions of adjustment.

10. The apparatus of claim 1 in which said elongated sound-muffling hose comprises an outer flexible tubular wall of fluid-impervious material and an inner tubular core of porous material having low thermal conductivity.

11. The apparatus of claim 10 in which said core is formed of polymeric foam.

12. The apparatus of claim 10 in which a helical spring having the coils thereof in axially-spaced relation extends through said tubular core.

13. The structure of claim 1 in which said apparatus is provided in combination with a worktable and a sewing machine mounted upon said worktable, said sewing machine having a reciprocable sewing needle and having a pressure foot assembly including a pressure foot bushing adjacent said needle; said base being secured to said worktable at a point spaced a substantial distance from said needle; and said nozzle assembly being secured to said pressure foot bushing for directing cooling air towards said needle.

* * * * *